United States Patent [19]

Uhlig

[11] 4,369,892

[45] Jan. 25, 1982

[54] CONTAINER WITH EXPANSION TYPE LOCKING CLOSURE

[75] Inventor: Albert R. Uhlig, Toledo, Ohio

[73] Assignee: Owens-Illinois, Inc., Toledo, Ohio

[21] Appl. No.: 792,757

[22] Filed: May 2, 1977

[51] Int. Cl.[3] ..... B65D 45/32

[52] U.S. Cl. ..... 220/320; 220/74; 229/43; 292/256.6

[58] Field of Search ..... 220/319, 320; 229/43; 292/256.6, 256.61, 256.63, 256.65, 256.67, 256.69

[56] References Cited

U.S. PATENT DOCUMENTS

| | | | |
|---|---|---|---|
| 264,347 | 9/1982 | Sexton | 220/74 |
| 786,957 | 4/1905 | Crane | 292/256.61 |
| 1,112,943 | 10/1914 | Stone | 220/74 |
| 1,889,505 | 11/1932 | Wackman | 220/74 |
| 2,787,410 | 4/1957 | Moore | 229/43 |
| 3,079,031 | 2/1963 | Henchert | 220/320 |
| 3,109,575 | 11/1963 | Aldington | 229/43 |
| 3,371,847 | 3/1968 | Stergle | 229/43 |

FOREIGN PATENT DOCUMENTS

| | | | |
|---|---|---|---|
| 810929 | 8/1951 | Fed. Rep. of Germany | 220/320 |

*Primary Examiner*—George E. Lowrance

*Attorney, Agent, or Firm*—Charles S. Lynch; Myron E. Click; David H. Wilson

[57] ABSTRACT

Disclosed is a closure system for a container made of flexible and resilient material comprising a lid engaging the finish of the container and an expansion means such as a toggle pressure ring pressing a sidewall of said lid outwardly against the finish of the container to lock and seal said lid on said container.

6 Claims, 12 Drawing Figures

CONTAINER WITH EXPANSION TYPE LOCKING CLOSURE

Wide mouth containers, including those made of flexible and resilient materials such as plastics, are normally covered with lids which are effective from the outside of the bottle finish towards the center and therefore create an outside holding force which results in a top sealing force on the end of the bottle. Continuous and interrupted thread finishes, but also snap fits are used. They all have the disadvantage of a tendency to strip off under increasing internal forces which are created by the product (gas, heat pressure) or container drop (impact).

It is an object of the invention to provide a new container-closure package, wherein the container is made of flexible and resilient material, that resists internal pressure and container drop.

It is another object to provide such a container-closure package resistant to side load.

It is a further object to provide such a container-closure package wherein the closure can easily and repeatedly be applied and removed.

These and other objects and aspects, as well as advantages, of the present invention will become apparent from the following description and drawings.

According to the present invention there is provided the combination of (1) a container made of flexible and resilient material and having a circular top opening defined by a finish portion terminating in an integral, annular flange having a top surface facing upwardly, forming a circular container lip, (2) a lid made of flexible, resilient material having a central circular closing portion conforming generally to said circular top opening and an elevated, inverted generally U-shaped circular rim adapted for engagement with said lip and (3) means for applying pressure radially outwardly against substantially the entire inner circmference of the lower portion of the inner sidewall of said rim to urge said sidewall into tight conformity with the upper portion of the finish to lock said lid onto said finish and seal the container.

FIGS. 1 and 2 perspective views of a container and lid with a toggle pressure ring in accordance with the present invention.

Figure 1:
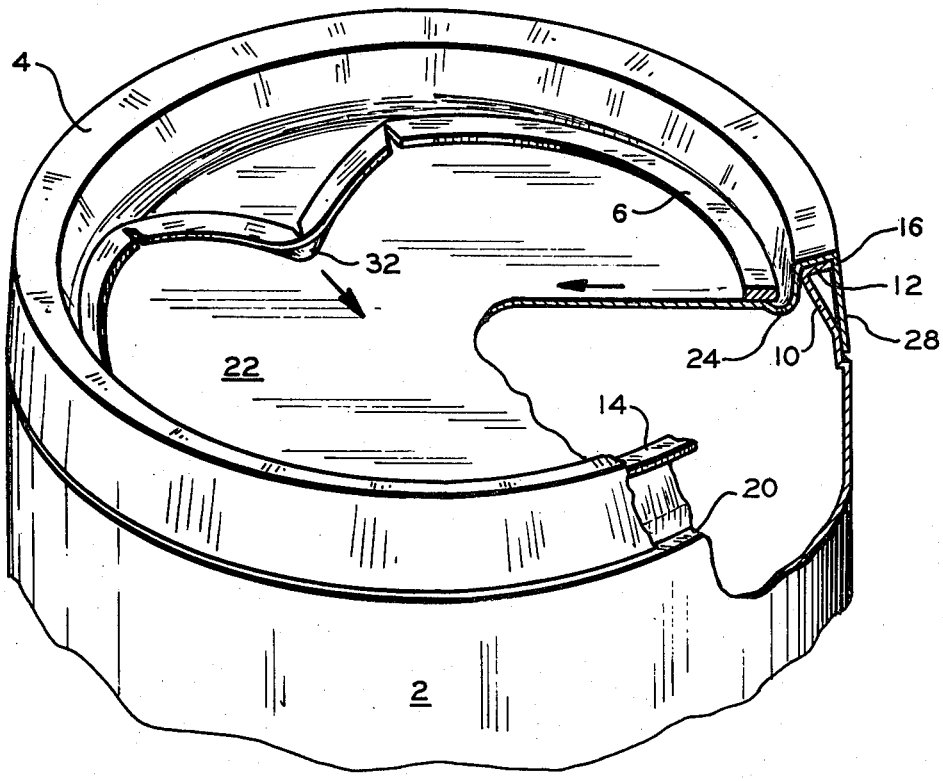
Figure 2:
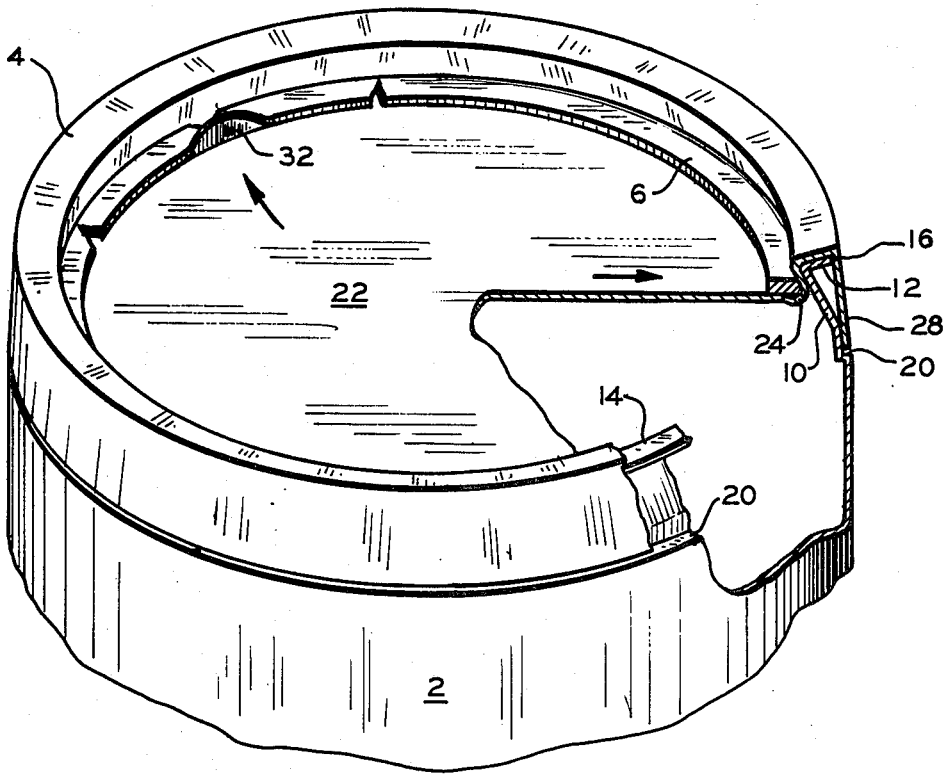
Figure 3:
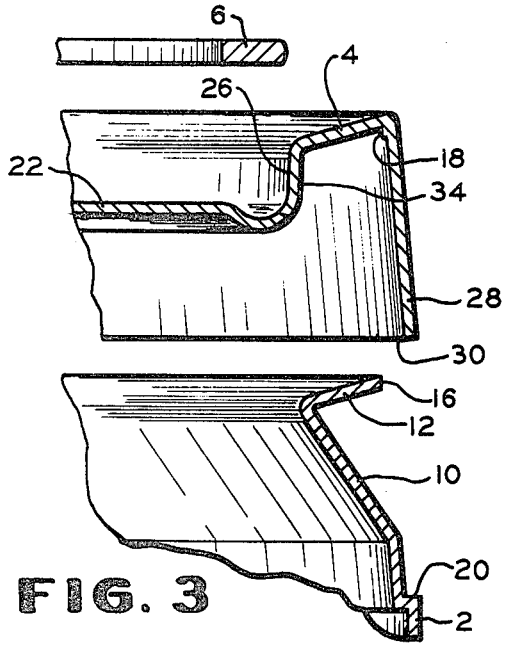
FIGS. 3, 4 and 5 are partial cross-sectional views illustrating the assembly of the container lid and toggle ring.

One embodiment of the present invention is illustrated in FIGS. 1–6. In the perspective views of FIGS. 1 and 2 is shown a container 2, lid 4 and toggle pressure ring 6, in assembled position but with a portion cut away for illustrative purposes. The bottom portion of 2 is not shown. The finish of container 2 terminates in conical portion 10 which is integrally connected to outwardly extending flange 12 having an upwardly facing top surface 14. Flange 12 is a circular container lip and has a peripheral end surface 16. If desired, annular projection 18 as shown in FIG. 3 can be provided to abut against 16 when in sealed position. This feature is desirable but is not necessary. Shoulder 20 of container 2 is also not entirely necessary but has appearance value and prevents lid 4 from overlapping the body of the container 2.

Lid 4 has a central circular closing portion 22. Although it is not entirely necessary, 22 can desirably have its annular peripheral portion 24 shaped in a downward curve so that when toggle 6 is expanded, some flattening of the curve 24 helps allow the expansion of the diameter of closing portion 22. The elevated rim 26 has an inverted generally U-shaped configuration in cross-section. Outer skirt 28 has a slightly larger diameter at its bottom than its top and is larger in circumference at the bottom periphery 30 (See FIG. 3) of its inner wall than the outer diameter of lip or flange 12.

Figure 4:
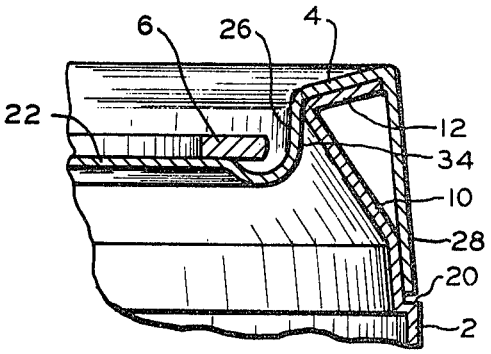
Figure 5:
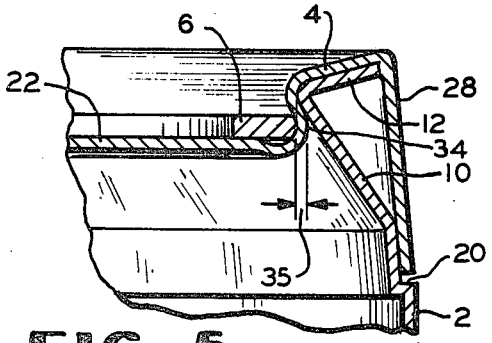

FIGS. 3, 4 and 5 are partial cross-sectional views of the container, lid and toggle ring of FIGS. 1 and 2 and illustrate the assembly of container 2, lid 4 and toggle ring 6. FIG. 1 corresponds to FIG. 4 (closed but not locked) and FIG. 2 corresponds to FIG. 5 (locked and sealed).

FIG. 3 shows the container 2 open with lid 4 about to be placed on top and toggle ring 6 ready to be placed in position. FIG. 3 shows lid 4 in position closing container 2 while toggle ring 3 is in the unexpanded position of FIG. 1. In this position lid 4 can easily be removed or put on container 2 conveniently. To lock and seal container as shown in FIG. 5 toggle ring 6 is expanded as by pushing outwardly on wall 32 shown in FIG. 1 to cause the ring to assume the expanded position of FIGS. 2 and 5. In order to unlock the lid, one pulls wall 32 of FIG. 2 toward the center of lid 4.

The effect of expanding pressure ring 6 is to press the inner skirt 34 radially outwardly all around its circumference to thus enlarge skirt 34 to a greater diameter than the diameter of the circular top opening of the container, thus forming an interference lock by virtue of the difference in diameter, as represented on FIG. 5 at 35. The further effect of such expansion is to pull the top of the rim and lip 12 and conical portion 10 of the finish inwardly and to pull the top portion of inner skirt 34 downwardly and outwardly. The effect of these movements is to form an excellent seal between lid 4 and the lip and conical portions of the container finish where these are in contact as shown in FIG. 5.

While it is not shown, in this and the other embodiments of the invention, an annular gasket can optionally be interposed between the lip of the container and the rim of the lid to aid in the sealing function.

An important advantage of the structure of the invention is that any internal pressure, caused for instance by an increase in temperature of liquid contained in the container, tends to increase the sealing and locking pressure upwardly on the ring-lid combination into tighter contact with the inner portion of the container finish at the interference area. With a conventional screw top cap on a wide-mouthed plastic container, internal pressure can strip the cap from the threads. Another advantage of the structure of the present invention is that it is also resistant to side load because such side load will simply cause an increase in the opposing force of the expanded pressure ring against the inner skirt of the lid.

A further advantage of the structure of the present invention is that it naturally lends itself to the possibility of making nesting containers for easy stacking. Thus, in one embodiment the container of the present invention has its bottom so shaped as to nest within the top of a like container of the present invention, as in FIG. 6.

Figure 6:
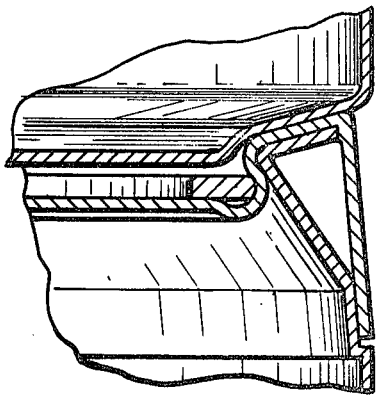
FIG. 6 is a partial cross-section of the invention illustrating stacking of the containers.

FIG. 6 illustrates this feature in partial cross-section wherein the bottom 36 of a container of the present invention is shown nested in the top of a closure structure of the present invention identical with that shown in FIG. 5.

The container of my invention can be constructed of any flexible and resilient material, for instance, polypropylene or high density polyethylene plastics made by a conventionl blow molding process, or even by an injection molding process. The lid can be made of any flexible and resilient material, including polypropylene or high density polyethylene plastics. It can be made by injection molding or by a thermoforming process, for instance.

Figure 8:
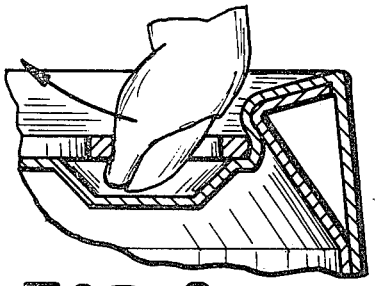
FIG. 8 is a partial cross-section view similar to FIG. 5 except for a recess in the lid.
Figure 7:
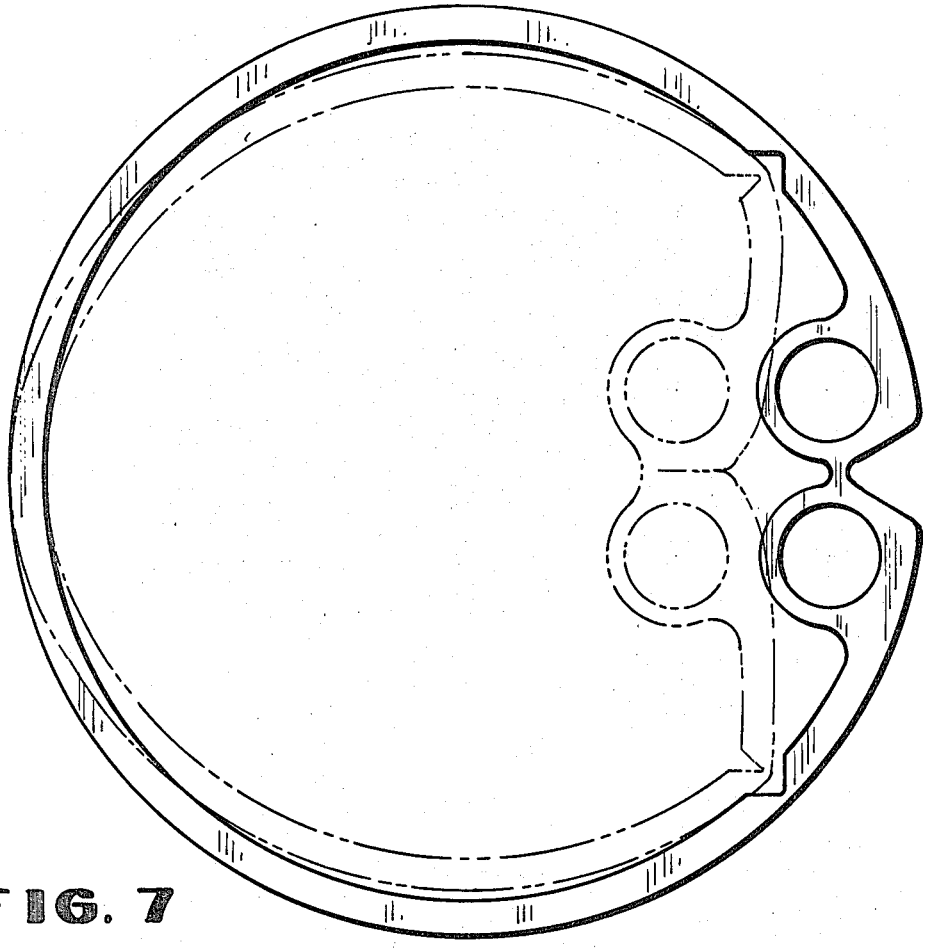
FIG. 7 is a perspective view of another form of the toggle ring.

The pressure ring can be of any suitable construction. It can be made by injection molding polypropylene or high density polyethylene. Another form of toggle ring which can be made of the same materials in the same manner is shown in FIG. 7 and 8. In FIG. 7 solid lines illustrate the ring in expanded position while dotted lines show the unexpanded position. Two finger holes are shown for opening and closing the toggle, although one finger hole will suffice. FIG. 8 is a partial cross-sectional view of the toggle in expanded position in a structure like that illustrated in FIG. 5, except that a recess for allowing easier access can be provided in the lid, as shown in FIG. 8.

Figure 9:
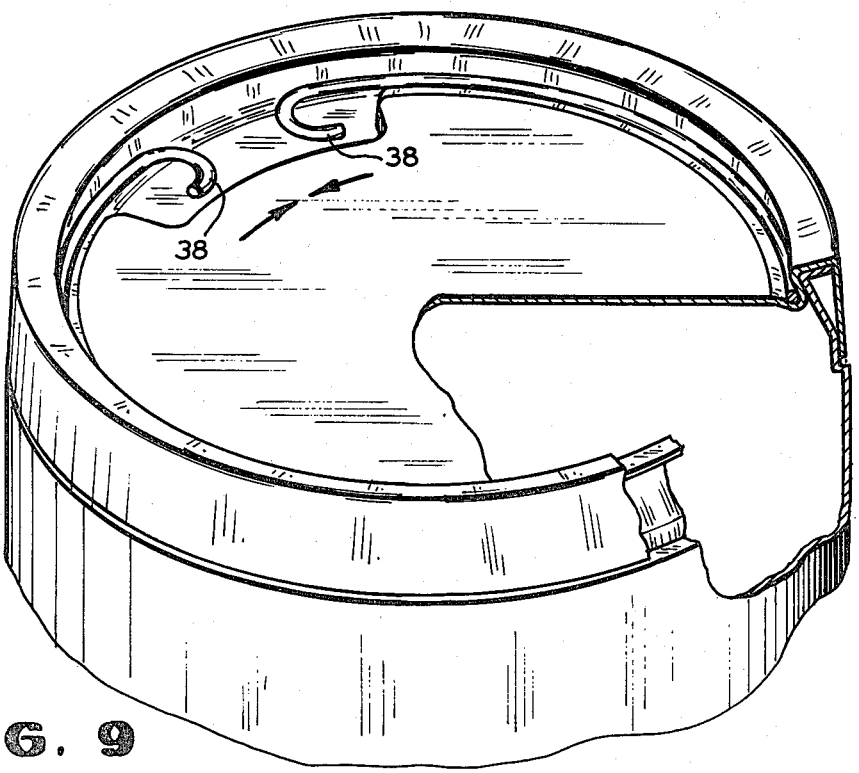
FIG. 9 is a perspective view of yet another form of the toggle ring.

FIG. 9 is similar to FIG. 2 except that the expanding pressure ring illustrated is made of spring steel and terminates in finger holds 38. To unlock the toggle and the lid one pulls the ring into a smaller circle by grasping the finger holds and pulling them toward each other.

Figure 10:
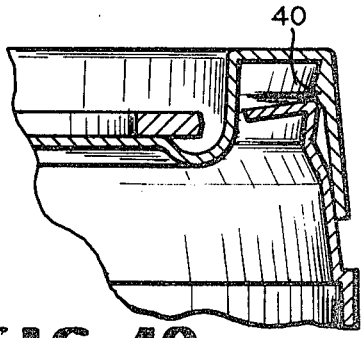
FIGS. 10, 11 and 12 are partial cross-sections of another embodiment of the invention.
Figure 11:
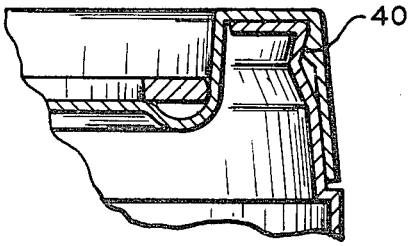
Figure 12:
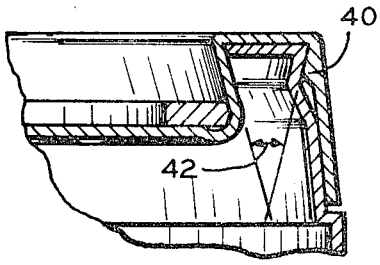

FIGS. 10, 11, and 12 illustrate another although less preferred embodiment of the invention. Here the finish has a frustoconical section which is topped by an inverted frustoconical section that terminates in an inwardly extending annular flange having a top surface facing upwardly and forming a circular container lip. The lid is as before described except that it contains an annular bead 40. FIG. 10 shows the beginning of assembly, FIG. 11 the assembled but unsealed and unlocked combination and FIG. 12 the fully locked and sealed position, where 42 indicates the retention angle accounting for the locking of the assembly.

While the toggle pressure rings illustrated are described as being made of plastic, it is to be noted that any suitable toggle pressure ring can be used. In fact for large plastic drums, such as 55 gallon drums a conventional steel toggle pressure ring is usually preferred.

As will be evident to those skilled in the art, various modifications of this invention can be made or followed in the light of the foregoing disclosure and discussion without departing from the spirit and scope of the disclosure or from the scope of the claims.

I claim:

1. In combination, (1) a container made of flexible, resilient material having a circular top opening, a finish portion extending upwardly and inwardly from the body of the container in the form of the frustum of a cone which terminates at the top in an integral, outwardly extending, annular flange having a top surface upwardly and forming a circular container lip, and wherein the confluence of said frustum and said lip defines said opening (2) a lid made of flexible, resilient material having a central circular closing portion conforming generally to said circular top opening but smaller in diameter than said opening and an elevated, inverted generally U-shaped circular rim having (i) an interior surface opposing said upwardly facing surface of said circular container lip and conforming in shape to said surface of said circular lip but being slightly wider (ii) an outer annular peripheral skirt having an outer wall and an inner wall (iii) an inner annular skirt having an outer wall and an inner wall, wherein the bottom periphery of the inner wall of said outer skirt is slightly larger in diameter than the diameter of the outwardly facing outer periphery of said circular lip and (3) an expanding pressure ring which is circular when in operative, extended position and is below the plane of said circular top opening, said pressure ring when in operative position pressing radially outwardly against the bottom portion of said outer wall of the inner annular skirt of said lid, thus (a) extending the diameter of the bottom portion of said inner skirt, so that the outer diameter of the lid in the plane of the ring is larger than the diameter of the top of said frustum, and thus locking the lid and (b) pulling said outer skirt into firm contact with the outwardly facing outer periphery of said circular lip, and pulling said opposing interior surface into contact with the upwardly facing surface, of said lip, thereby forming a seal with said container finish.

2. The combination of claim 1 wherein said expanding pressure ring is a toggle ring.

3. The combination of claim 1 wherein when in assembled combination an annular gasket is interposed between at least a portion of said lip and said rim.

4. The combination of claim 1 wherein said container and said lid are made of plastic.

5. In combination, (1) a container made of flexible, resilient material having a circlar top opening, a finish portion extending upwardly and inwardly from the body of the container in the form of the frustum of a cone which terminaates at the top in an integral, outwardly extending, annular flange having a top surface facing upwardly and forming a circular container lip, and wherein the confluence of said frustum and said lip defines said opening (2) a lid made of flexible, resilient material having a central circular closing portion conforming generally to said circular top opening but smaller in diameter than said opening and an elevated, inverted generally U-shaped circular rim having (i) an interior surface opposing said upwardly facing surface of said circular container lip and which is slightly wider than said container lip (ii) an outer annular peripheral skirt having an outer wall and an inner wall (iii) an inner annular skirt having an outer wall and an inner wall, wherein the bottom periphery of the inner wall of said outer skirt is slightly larger in diameter than the diameter of the outwardly facing outer periphery of said circular lip and (3) an expanding pressure ring which is circular when in operative, extended position and is below the plane of said circular top opening, said pressure ring when in operative position pressing radially outwardly against the bottom portion of said outer wall of the inner annular skirt of said lid, thus (a) extending the diameter of the bottom portion of said inner skirt, so that the outer diameter of the lid in the plane of the ring is larger than the diameter of the top of said frustum, and thus locking the lid and (b) pulling said outer skirt into firm contact with the outwardly facing outer periphery of said circular lip, and pulling said opposing interior surface into contact with the upwardly facing surface, of said lip, thereby forming a seal with said container finish.

6. In combination, (1) a container made of flexible, resilient material having a circular top opening, a finish portion extending upwardly and inwardly from the body of the container in the form of the frustum of a cone which terminates at the top in an integral, outwardly extending, annular flange having a top surface facing upwardly and forming a circular container lip, and wherein the confluence of said frustum and said lip defines said opening (2) a lid made of flexible, resilient material having a central circular closing portion conforming generally to said circular top opening but smaller in diameter than said opening and an elevated, inverted generally U-shaped circular rim adapted for engagement with said lip and (3) means for applying pressure radially outwardly against substantially the entire inner circmference of the lower portion of the inner sidewall of said rim to urge said sidewall into tight conformity with the upper portion of the conical portion of the finish to lock said lid onto said finish and seal the container.

* * * * *

UNITED STATES PATENT AND TRADEMARK OFFICE

CERTIFICATE OF CORRECTION

PATENT NO. : 4,369,892

DATED : January 25, 1983

INVENTOR(S) : Albert R. Uhlig

It is certified that error appears in the above-identified patent and that said Letters Patent is hereby corrected as shown below:

Title page, Item (45), "January 25, 1982" should read -- January 25, 1983 --

Signed and Sealed this

*Twelfth* Day of *April 1983*

[SEAL]

*Attest:*

GERALD J. MOSSINGHOFF

*Attesting Officer*

*Commissioner of Patents and Trademarks*